US007438295B2

(12) United States Patent
Aida

(10) Patent No.: US 7,438,295 B2
(45) Date of Patent: Oct. 21, 2008

(54) CARD GAME

(76) Inventor: Masao Aida, 8238 Park Place, Courtenay, British Columbia (CA) V9N 8N1

( * ) Notice: Subject to any disclaimer, the term of this patent is extended or adjusted under 35 U.S.C. 154(b) by 0 days.

(21) Appl. No.: 11/296,161

(22) Filed: Dec. 7, 2005

(65) Prior Publication Data

US 2006/0273518 A1 Dec. 7, 2006

Related U.S. Application Data

(60) Provisional application No. 60/687,906, filed on Jun. 7, 2005.

(51) Int. Cl.
*A63F 1/00* (2006.01)

(52) U.S. Cl. ..... 273/292

(58) Field of Classification Search ..... 273/292, 273/303, 304, 306, 274
See application file for complete search history.

(56) References Cited

U.S. PATENT DOCUMENTS 5,382,025 A * 1/1995 Sklansky et al. ..... 273/292
5,489,101 A * 2/1996 Moody ..... 273/292
5,657,993 A * 8/1997 Merlino et al. ..... 273/292
5,678,821 A * 10/1997 Hedman ..... 273/292
5,845,907 A * 12/1998 Wells ..... 273/292
6,102,402 A * 8/2000 Scott et al. ..... 273/292
6,132,311 A * 10/2000 Williams ..... 463/13
6,206,373 B1 * 3/2001 Garrod ..... 273/292
6,379,245 B2 * 4/2002 De Keller ..... 463/13
6,422,564 B1 * 7/2002 Baranauskas ..... 273/292
6,474,644 B1 * 11/2002 Pickle et al. ..... 273/274
6,511,068 B1 1/2003 Sklansky et al.
6,547,247 B2 * 4/2003 Hoyt et al. ..... 273/292
6,637,746 B1 * 10/2003 Baranauskas ..... 273/292
6,651,983 B1 * 11/2003 Chobanian ..... 273/292
6,705,613 B1 * 3/2004 Wirth ..... 273/274
6,817,615 B1 * 11/2004 Dacey ..... 273/292
6,959,928 B2 * 11/2005 Schultz ..... 273/292
2002/0125642 A1 * 9/2002 Wells ..... 273/292
2003/0094761 A1 * 5/2003 Furuta et al. ..... 273/292
2004/0121831 A1 6/2004 Perkins
2004/0183254 A1 9/2004 Schlumbrecht
2005/0104292 A1 5/2005 Schultz
2005/0151319 A1 * 7/2005 Berman et al. ..... 273/292
2005/0161884 A1 * 7/2005 Au-Yeung et al. ..... 273/292

* cited by examiner

*Primary Examiner*—Gene Kim
*Assistant Examiner*—Dolores Collins
(74) *Attorney, Agent, or Firm*—Rob L. Phillips; Greenberg Traurig

(57) ABSTRACT

A method of conducting a poker game is disclosed. The method may be played as a player v. house (i.e., dealer) or player v. player game and may be facilitated in an online version or on electronic gaming devices. The method comprises each participating receiving five hole cards, two of which, are used in combination with three common cards. Three sets of three common cards are dealt such that after each set is dealt, each player discards one hole card. Consequently, at the end of the game, each player has two hole cards and nine common cards are presented in a pattern, such as a 3×3 matrix. Each player combines his or her two hole cards with three common cards (e.g., a row, column or diagonal) from the 3×3 matrix to form a five-card poker hand.

13 Claims, 10 Drawing Sheets

CARD GAME

CROSS REFERENCE TO RELATED APPLICATIONS

This application claims the benefit of Provisional Application No. 60/687,906 filed Jun. 7, 2005.

FIELD OF THE INVENTION

The embodiments of the present invention relate to a casino card game. More particularly, the embodiments of the present invention comprise a new poker style game for play in casinos, live and online card rooms and on electronic gaming devices.

BACKGROUND

Poker continues to attract a large number of new players. The recent popularity explosion associated with poker can be credited to television and the Internet. Televised poker tournaments can be seen on ESPN, FOX, NBC and the Travel Channel. Moreover, hundreds of online websites are dedicated to facilitating poker games between players from remote locations. Nothing better underscores the popularity of poker than the increase in the number of entries for the previous three World Series of Poker tournaments held in Las Vegas each year. In 2003 there were 839 entries; in 2004 there were 2576 entries; and in 2005 there were 5619 entries. The increase in the number of entries continues despite a $10,000 entry fee.

The most popular poker games being played today are Texas Hold'em, Omaha and Seven Card Stud. However, playing the same poker games over and over can become boring or uninteresting. With so many new players being attracted to poker, it makes sense to introduce new poker games to maintain the interest of the poker players.

There continues to be a need for a new poker game designed to compete with the most popular poker games being played today.

SUMMARY

Accordingly, a first embodiment of the present invention is a method of conducting a poker game having one or more betting rounds comprising providing one or more players with three to five, face-down hole cards; providing multiple sets of face-up common cards such that said common cards form a pattern; causing each player to discard, one at a time, hole cards such that at an end of the game each player holds two hole cards, said hole cards being discarded in response to one or more of the multiple sets of common cards being provided; evaluating poker hand ranks by combining each player's remaining two hole cards with three common cards forming part of the pattern; and awarding one or more players a pot or payout for holding one or more winning poker hands.

The poker game combines the attributes of Texas Hold'em and draw poker. That is, like Texas Hold'em, common cards are utilized, and like draw poker, players are able to discard unwanted cards. However, unlike draw poker, the discard rules of the embodiments of the present invention are structured and mandatory. Accordingly, in one embodiment, each participating player forms a final poker hand by combining his or her two hole cards with three cards from the common card matrix. In one embodiment, the pattern is a 3×3 matrix and each player may combine his or her two hole cards with three cards forming a row, column or diagonal of the common card matrix. The embodiments of the present invention may also incorporate high and/or low poker hands with split pots.

The embodiments of the present invention may be implemented live or online as player v. player or player v. dealer games. The embodiments may also be facilitated by electronic gaming devices or a global computer network (e.g., the Internet).

Other variations, embodiments and features of the present invention will become evident from the following detailed description, drawings and claims.

DETAILED DESCRIPTION

Figure 1A:
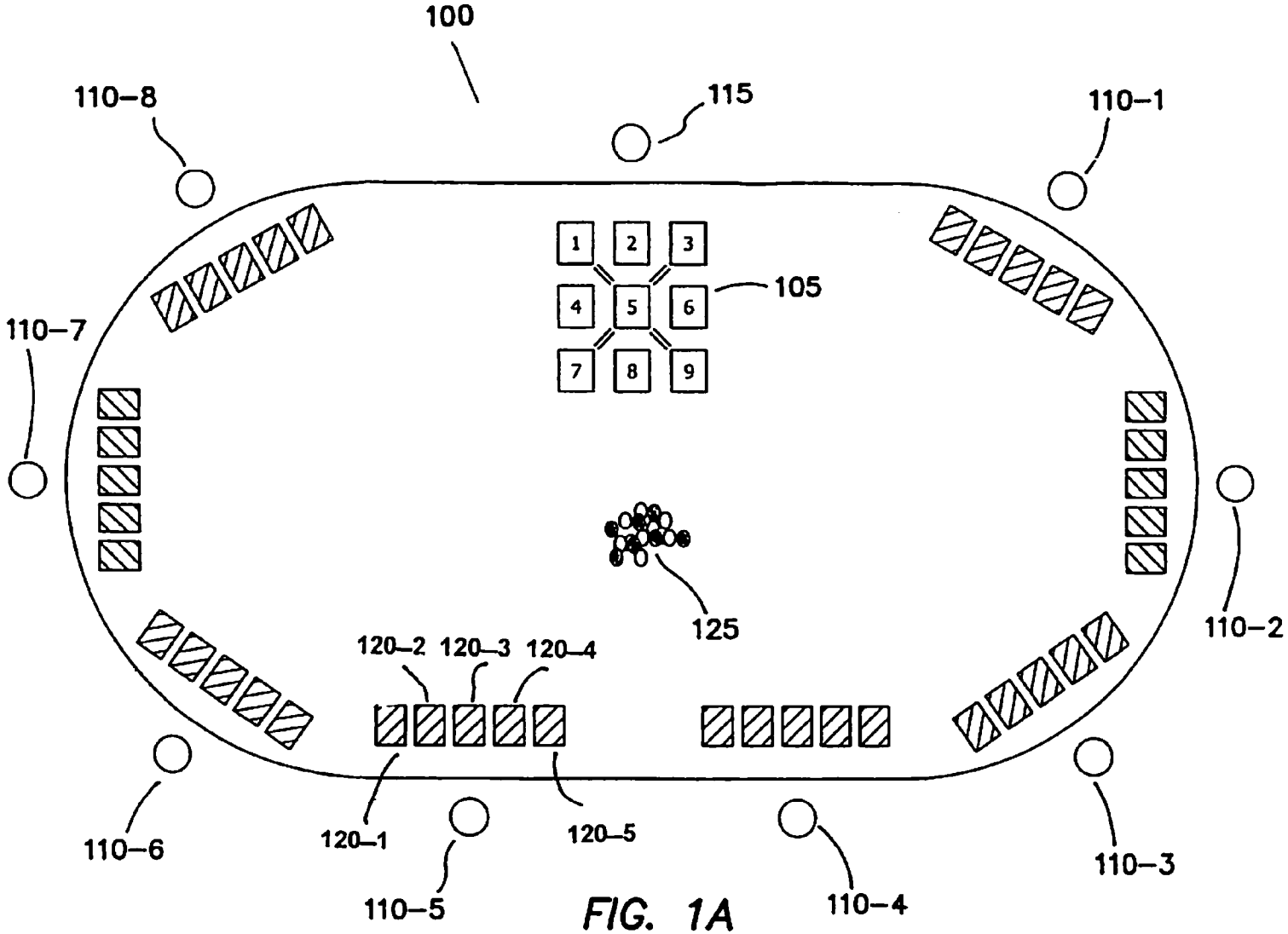
FIGS. 1*a-d* illustrate a play progression of one exemplary player v. player embodiment of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Figure 1B:
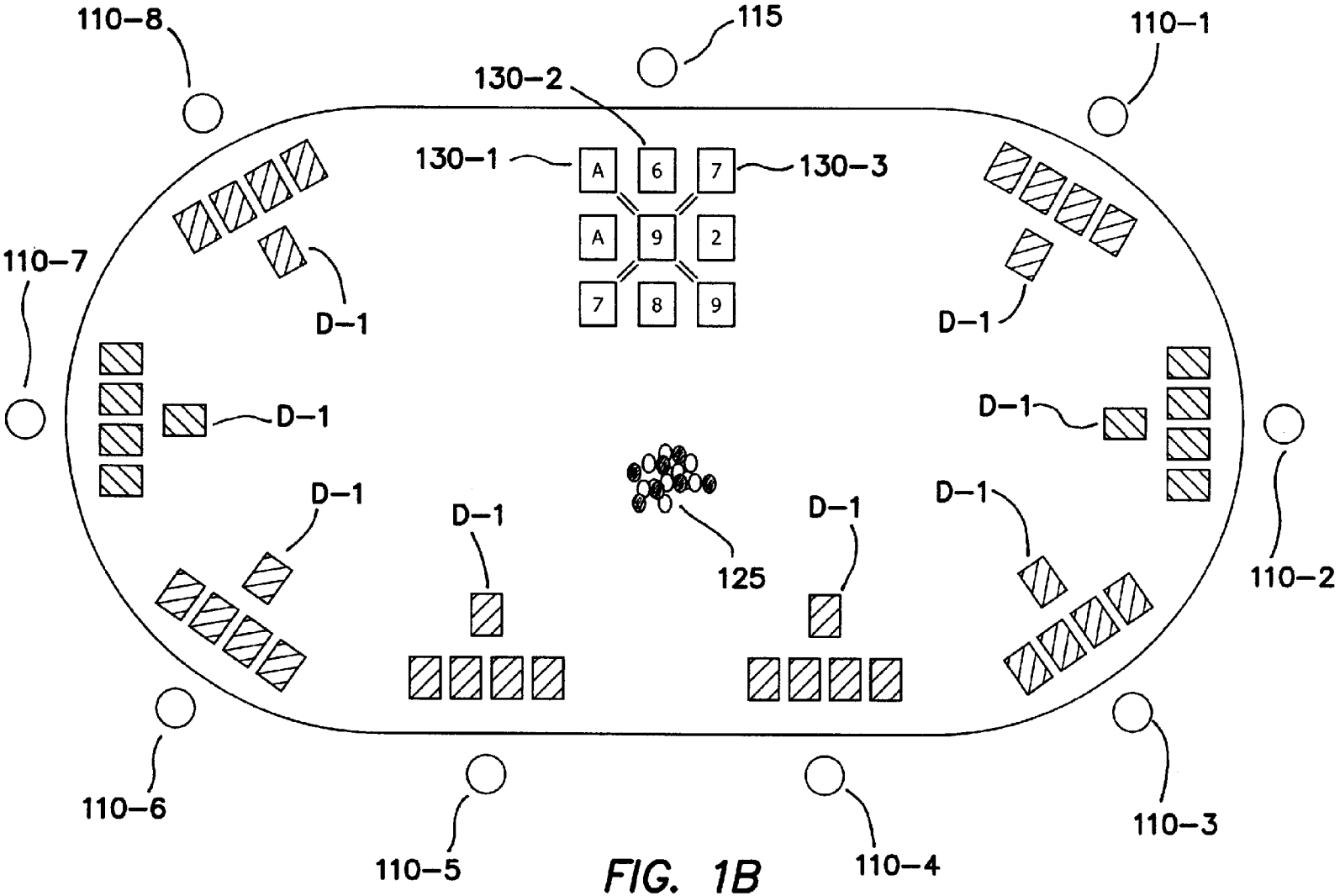
Figure 1C:
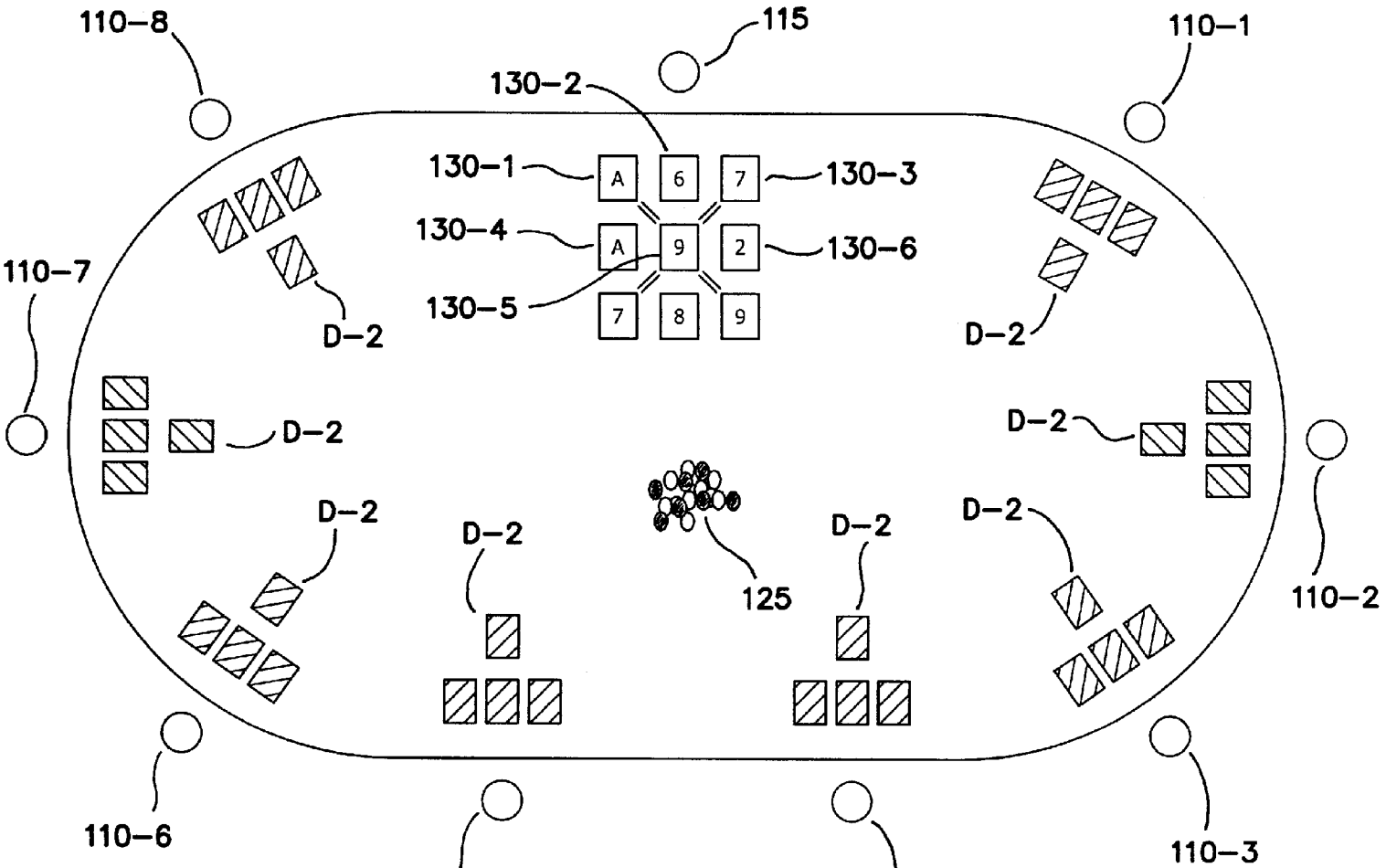
Figure 1D:
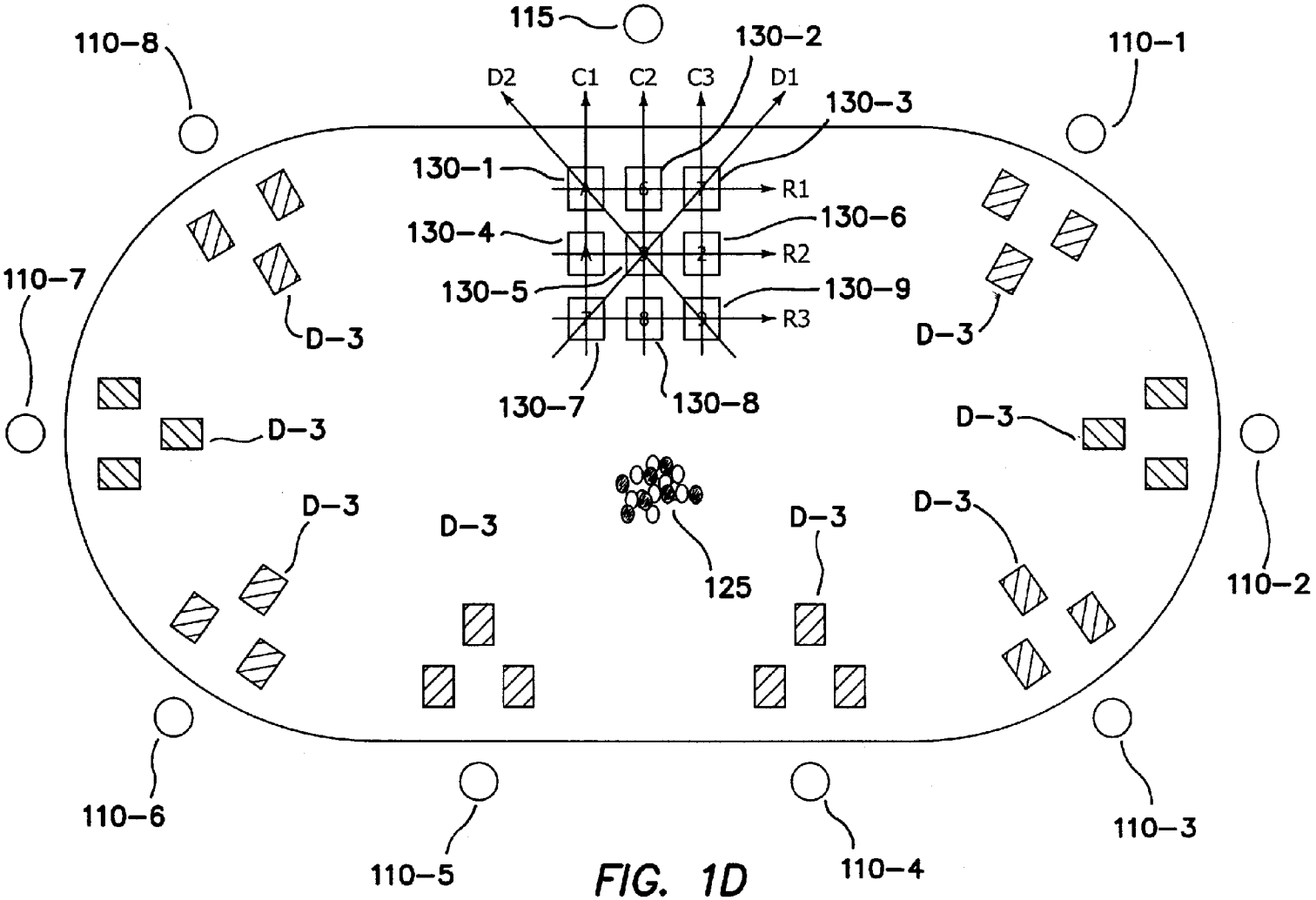

Reference is now made to the figures wherein like parts are referred to by like numerals throughout. FIG. 1*a* shows an overhead view of a live, or online simulated, poker table 100 accommodating up to eight player positions 110-1 through 110-8 and a dealer position 115. A center area of the table depicts a 3×3 numbered matrix 105 for placement of common cards. As shown, five, face-down hole cards 120-1 through 120-5 have been dealt adjacent to each player position 110-1 through 110-8. Each player is able to view his or her hole cards upon being dealt or provided the same. A first betting round then ensues wherein each participating player may, bet, fold, check, raise or call thereby establishing a pot 125. Next, as shown in FIG. 1*b*, a dealer deals a set of three, face-up common cards 130-1 through 130-3 and a second betting round ensues. After the second betting round concludes, each remaining player must discard one hole card identified as D-1 in FIG. 1*b*. FIG. 1*c* shows a second set of three, face-up common cards 130-4 through 130-6 which has been dealt adjacent to the first set of common cards 130-1 through 130-3. After a third betting round concludes, each player must discard another hole card identified as D-2. FIG. 1*d* shows a third set of three, face-up common cards 130-7 through 130-9 which has been dealt adjacent to the first two sets of common cards 130-1 through 130-6. After a fourth betting round, each player must discard a final hole card identified as D-3.

Figure 2:
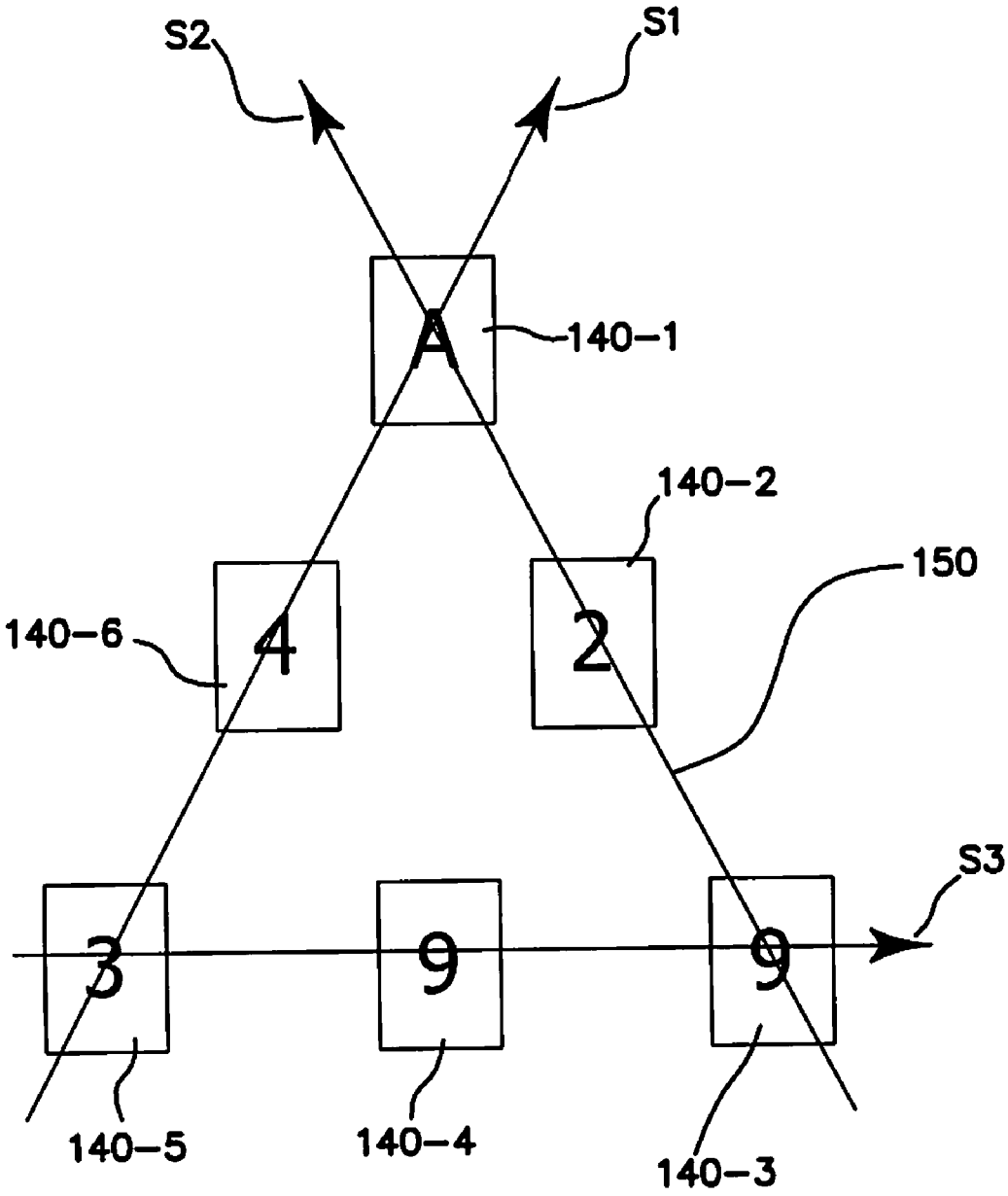
FIG. 2 shows an alternative common card configuration.
Figure 3:
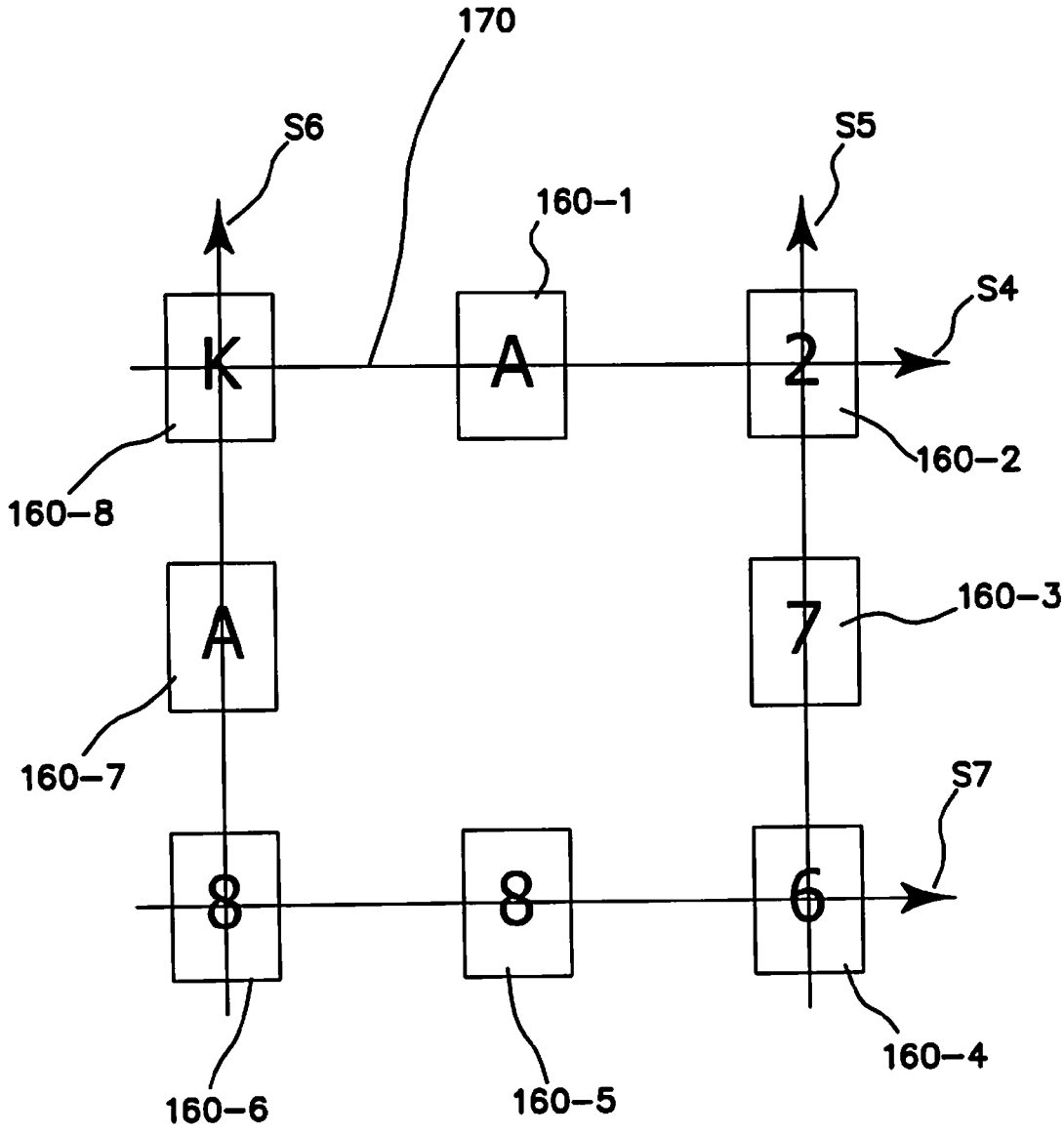
FIG. 3 shows an alternative common card configuration.

After the third and final discard, each participating player forms his or her best poker hand by combining his or her two remaining hole cards with three of the common cards 130-1 through 130-9. Ideally, each player may combine his or her hole cards with any row (R-1 through R-3), column (C-1 through C-3) or diagonal (D-1 through D-2) comprising three common cards. Besides the 3×3 matrix of common cards 130-1 through 130-9, other configurations, patterns and/or numbers of common cards may be utilized without departing from the scope and spirit of the present invention. For example, six common cards 140-1 through 140-6 may be configured as a pyramid or triangle 150 with three sides (FIG. 2) or eight common cards 160-1 through 160-8 may be configured as a square 170 with three cards forming each side (FIG. 3). The triangle 150 provides players with three combination options comprising the sides S-1 through S-3 and the square 170 provides four combination options S-4-through S-7.

Depending on the specific poker game, final, winning poker hands may be evaluated as high and/or low. In a high/low version, a player holding the highest poker hand splits the pot with a player holding the lowest poker hand. In addition, like Texas Hold'em, a game played according to the embodiments of the present invention may incorporate blind wagers. Blind wagers are mandatory wagers which are placed prior to any hole cards being dealt. Typically, during each poker hand, one player is designated the small blind and another adjacent player is designated the large blind. The small and large blinds rotate after the conclusion of each poker hand. Blind wagers encourage action and build larger pots.

Figure 4:
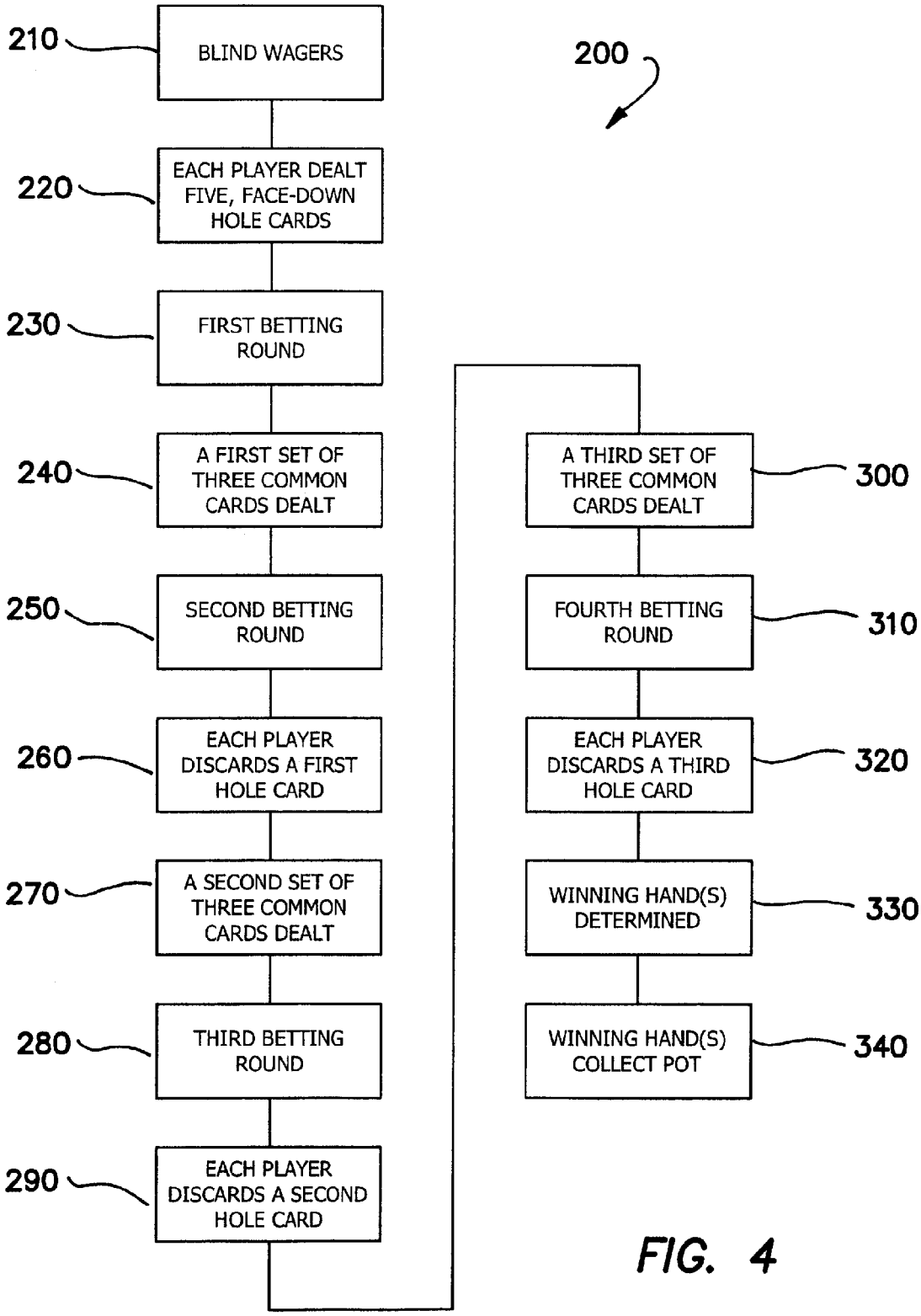
FIG. 4 illustrates a flow chart detailing one exemplary player v. player embodiment of the present invention

FIG. 4 illustrates a flow chart 200 detailing one method of play of one live player v. player embodiment of the present invention. One player places a small blind wager and one player places a large blind wager 210. Each player is then dealt five, face-down hole cards 220. A betting round then ensues whereby a player to left of the large blind is first to act 230. Each player in a clockwise fashion then acts. Once the first betting round concludes, three, face-up common cards are dealt in a row near a center of the poker table 240. A second betting round ensues 250. Each player must then discard one of his or her hole cards 260. The dealer collects the hole cards in a face-down manner to prevent players from observing the rank and suit of the discards. Once each player has discarded one hole card, the dealer deals a second set of three, face-up common cards adjacent to the first three common cards 270. More specifically the second three common cards are dealt below, and in alignment with, the first three common cards. A third betting round ensues 280. Each player must then discard one of his or her four remaining hole cards 290. Thereafter, a third set of three, face-up common cards is dealt adjacent to the prior two sets of common cards 300. More specifically, the third set of three common cards is dealt below, and in alignment, with the second three common cards thereby forming a 3×3 matrix of common cards. A fourth betting round ensues 310. Each player must then discard a final hole card, leaving each remaining player with two hole cards 320. A winning hand(s) is determined by combining each player's two hole cards with a row, column or diagonal of the common card matrix 330. Accordingly, each player has a five-card poker hand (i.e., two hole cards and three common cards) that may be evaluated against the five-card poker hands of each other player to determine a winning poker hand. The player(s) with the winning poker hand(s) collects the pot 340. The house takes a rake from each pot 340.

Although the description heretofore as discussed five hole cards, it is also possible to play similar games with each player receiving initially three or four hole cards whereby hole cards are discarded in a different manner such that players still hold two hole cards at the end of the game. For example, in a game with four initial hole cards being dealt, players may make a discard after the first and second sets of common cards, first and third sets of common cards or second and third sets of common cards are dealt.

The embodiments of the present invention are ideal for player v. player games in both live and online settings. In online settings, remotely located players login to a dedicated server via a poker website and select the table and poker game of their choice. As the technology for operating online poker rooms is well-known, the specifics are not disclosed herein. Suffice it to say that the embodiments of the present invention may be facilitated in an online manner like other poker games are now offered online. However, as set forth below, the embodiments of the present invention are also suitable for player v. dealer and player v. pay table games.

Figure 5:
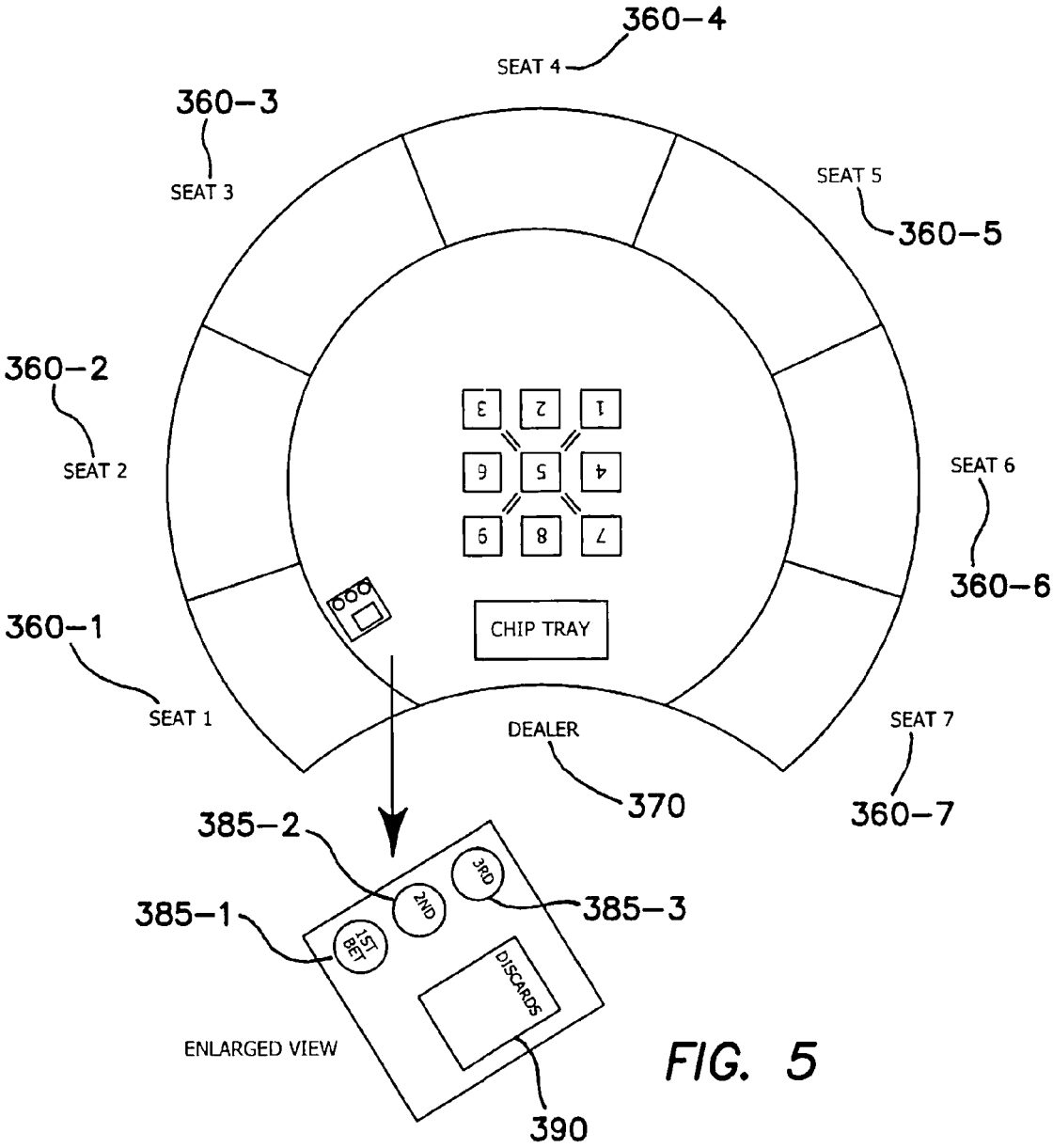
FIG. 5 illustrates a gaming table for one exemplary player v. dealer embodiment of the present invention.

The method described above may also be utilized in a player v. dealer embodiment played at a live gaming table with the use of a deck of cards and a dealer. FIG. 5 shows a player v. dealer gaming table 350 accommodating seven player positions 360-1 through 360-7 and a dealer position 370. A center area of the table depicts a 3×3 matrix 380 for placement of common cards. Adjacent to each player position 360-1 through 360-7 there are depicted three wager areas 385-1 through 385-3 and a discard area 390. In this embodiment, each participating player places an initial wager in wager area 385-1 and is then dealt five, face-down hole cards. The dealer is also dealt five, face-down hole cards. The limits of the game wagers are established by the casino or card room offering the game. The dealer then deals three, face-up common cards into the 3×3 matrix 380. Each player then places a second wager, equal to the first wager, in wager area 385-2 and discards, along with the dealer, one hole card in a face-down manner. Each player may also fold his or her hand thereby losing the initial wager. The discards are placed face down in the discard area 390. The dealer then deals the next three, face-up common cards into the 3×3 matrix 380. Each player then places a third wager, equal to the first and second wagers, in wager area 385-3 and discards, along with the dealer, one hole card in a face-down manner. Each player may also fold his or her hand thereby losing the first and second wagers. The dealer then deals the final three, face-up common cards such that the 3×3 matrix 380 is full. Each player, along with the dealer, then discards one additional hole card leaving each player and the dealer with two hole cards. Each player, and the dealer, then flips over his or her two hole cards and the dealer systematically evaluates each player's best hand against the dealer's best hand. Players holding hands which outrank the dealer's hand are paid a winning amount based on their wager amounts. Players holding hands not outranking the dealer's hand lose their wagers. Tie hands are considered a push such that the player keeps the wagers placed during the game.

It should be understood that the permissible amount of the multiple wagers may be altered such that players may be permitted to increase the wager amounts as the game progresses. For example, players may be permitted to place second and third wagers which are twice that of the first wager. Any wagering scheme is conceivable. Also, a fourth wager may be permitted after the final three common cards are dealt into the 3×3 matrix 380.

In another live embodiment, the dealer only deals the game and does not participate as a player. In such an embodiment, each player's final best poker hand is compared to a pay table such that if a player's final poker hand formed by the combination of the two hole cards and a row, column or diagonal of the 3×3 matrix 380 is of sufficient rank, the player is provided a corresponding award based on the wager amounts and the rank of the poker hand. If not, the player loses his or her wagers. Ideally, only the best poker hand is considered in determining the appropriate payout. That is, it is possible that multiple combinations may form winning hands pursuant to the pay table. Conventional and progressive jackpots may be associated with particularly high ranking poker hands (e.g., Royal Flush). The game may be played as a high and/or low poker game.

Figure 6:
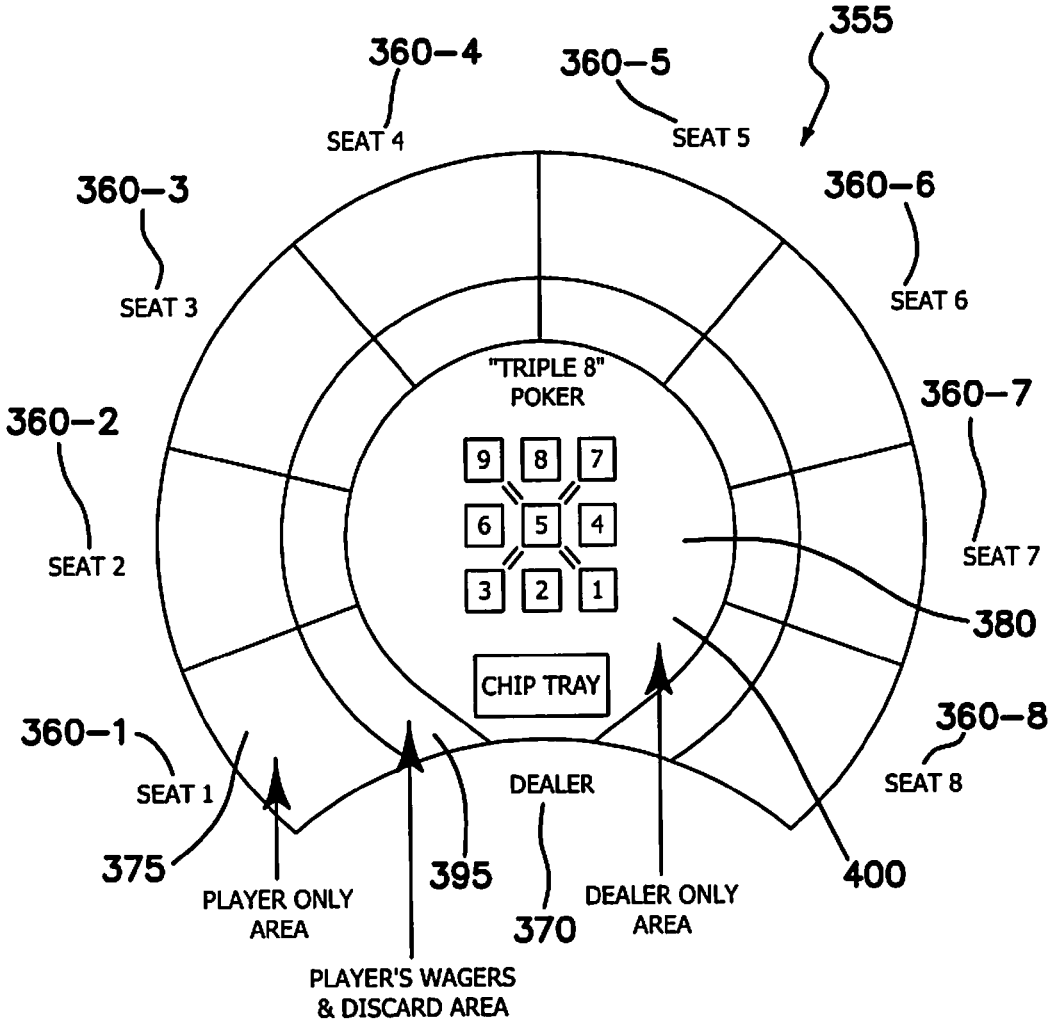
FIG. 6 illustrates a gaming table for one exemplary player v. player embodiment of the present invention.

FIG. 6 shows a player v. player gaming table 355, accommodates eight player positions 360-1 through 360-8 and a dealer position 370. The table 355 allows the player v. player game to be played on a casino floor, like blackjack, rather than only in a poker room. That is, the size of the table 355 is such that it does not occupy too much of the casino floor. The table 355 depicts a 3×3 matrix 380 for placement of common cards. Adjacent to each player position 360-1 through 360-8 is a player card area 375 and a player wager and discard area 395. The player card area 375, player wager and discard area 395 and dealer area 400 may all be different colors to distinguish each from the others. The player v. player casino floor game is played exactly like the poker room game detailed in FIGS. 1*a*-1*d*.

Figure 7:
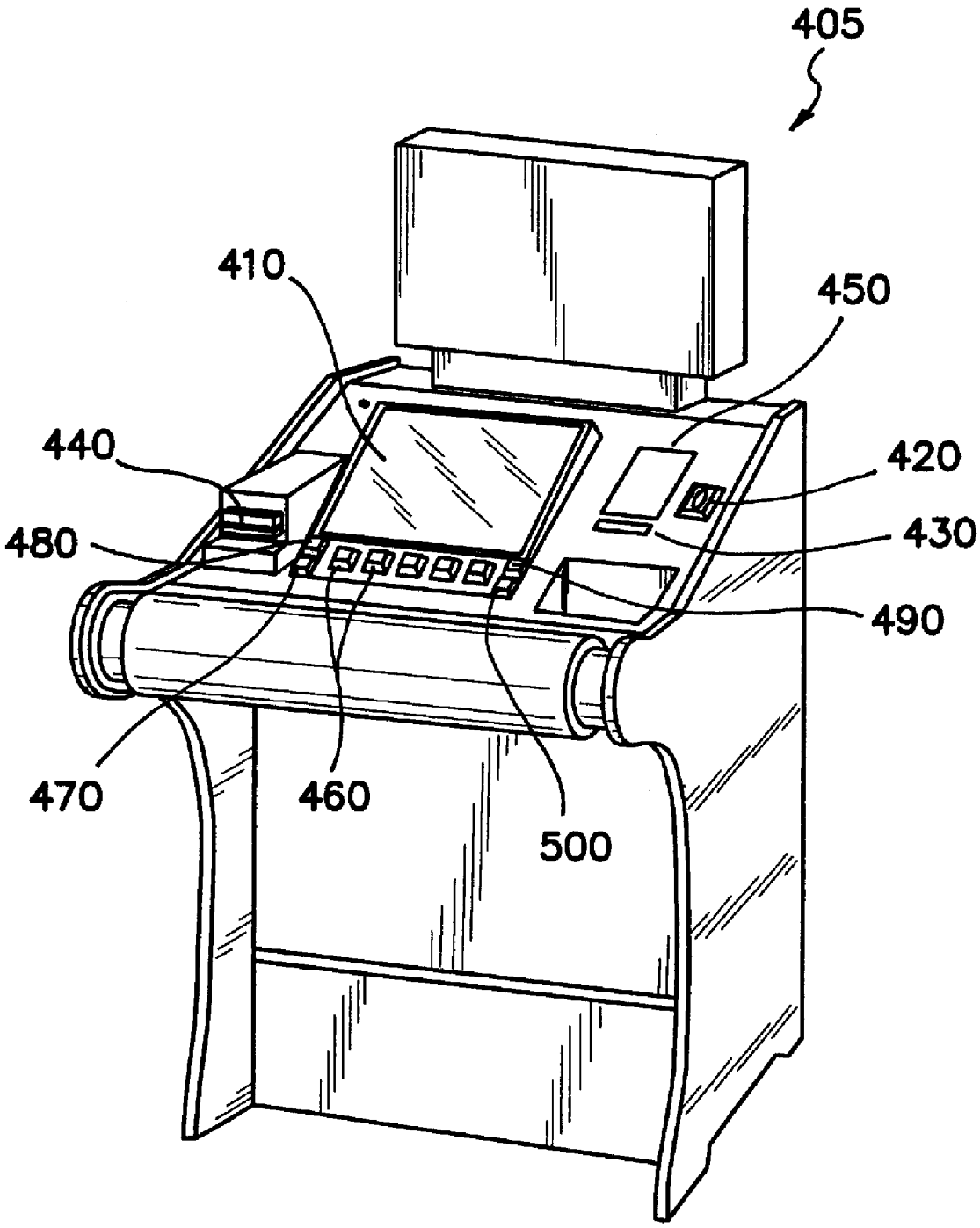
FIG. 7 illustrates an electronic gaming device of the type that may be used to facilitate an electronic version of the present invention.

FIG. 7 shows an electronic gaming device 405 of the type that may facilitate the embodiments of the present invention. The device 405 includes a display 410, coin input 420, bill and/or coupon validator 430, player card reader 440, credit display 450, discard buttons 460, bet one unit button 470, bet max units button 480, deal button 490 and cash out button 500. Alternatively or additionally, the functions of buttons 460-500 may also be facilitated by touch screen technology. With the electronic gaming device 405, a player plays the poker game against a pre-established pay table. The pay table includes payouts for certain final, high-ranking poker hands obtained by the player.

The operation of electronic gaming devices (e.g., slot machines and video poker machines) is controlled by microprocessors which communicate with internal memory devices and the external features of the devices. The microprocessors also incorporate, or communicate with, a random number generator which ensures the randomness of the device's outcomes. In the embodiments of the present invention, one or more processors, along with memory and related devices, control the new applications disclosed herein. Therefore, the embodiments of the present invention, along with the corresponding odds, may be programmed into the processor or associated software. Since the technology for operating and controlling electronic gaming devices is well known to those skilled in the art, the subtle details are not described herein.

With the electronic gaming device 405, the player places an initial wager. Then, in response to pressing the deal button 490, the display 410 shows five, face-up player cards and three, face-up common cards. The player must now place a second wager, equal to the first wager, and use one of the discard buttons to discard one player card. Then, three additional face-up, common cards are displayed. The player must now place a third wager, equal to the first and second wagers, and discard another player card. Then, three final, face-up cards are displayed. The player now discards one additional player card. Next, the device 405 evaluates all combinations of the player's two hole cards with each row, column and diagonal formed by the common cards. If the best poker hand formed by the combination is of sufficient rank, the player is provided a corresponding award based on the wager amounts and the rank of the poker hand. If not, the player loses his or her wagers. Ideally, only the best poker hand is considered in determining the appropriate payout. The game may be played as a high and/or low poker game. Conventional and progressive jackpots may be associated with particularly strong poker hands (e.g., Royal Flush).

Again, it should be understood that the amount of the multiple wagers may be altered such that players may be permitted to increase the wager amounts as the game progresses and more, or less, than three wagers may be permitted.

The embodiments of the present invention will appeal to the average poker play who is seeking fun and excitement. Moreover, the embodiments will encourage more players to participate in a per-hand basis since even modest hole cards may form, along with the multiple common cards and numerous "flops," a high-ranking poker hand. With more players participating, the pots will be larger benefiting both winning players and the casino which derives its profit from a rake of the pot. Dealers will also benefit as larger pots encourage larger tips. The embodiments offer many player decisions thereby maintaining player interest and preventing the game from becoming stale. The poker game played pursuant the embodiments of the present invention are also less complicated than some other poker games like Omaha 8.

Although the invention has been described in detail with reference to several embodiments, additional variations and modifications exist within the scope and spirit of the invention as described and defined in the following claims.

I claim:

1. A method of conducting a card game having one or more betting rounds comprising:

dealing one or more players, and a dealer, three to five, face-down hole cards;

dealing common cards face-up in a interrelated pattern, said common cards being dealt in at least two stages, wherein the pattern is not a single straight line and includes at least two pre-designated groups of unique common cards wherein at least two pre-designated groups of unique common cards within the interrelated pattern include at least one same common card;

regardless of a poker strength of the three to five face-down hole cards, requiring each player and the dealer to discard at least one hole card after each of said at least two common card dealing stages such that at an end of the game each player and the dealer holds only two hole cards;

after all common cards have been revealed, evaluating poker hand ranks by combining each player's, and the dealer's, two hole cards with any pre-designated group of three common cards forming part of the pattern such that each player's five-card hand and the dealer's five-card hand is of the highest poker hand rank possible; and awarding one or more players a payout for holding a poker hand outranking said dealer's best poker hand.

2. The method of claim 1 further comprising providing five, face-down hole cards and three sets of common cards, each set comprising three cards.

3. The method of claim 2 further comprising requiring each player and the dealer to discard one hole card after each of the three sets of common cards is dealt and revealed.

4. The method of claim 2 further comprising arranging the three sets of common cards as a pattern comprising a 3×3 matrix.

5. The method of claim 4 further comprising requiring each player and the dealer to combine the two hole cards with three cards from a row, column or diagonal of the 3×3 matrix to form a five-card poker hand.

6. The method of claim 1 further comprising providing a payout for a low-ranking poker hand or a high-ranking poker hand.

7. The method of claim 1 further comprising incorporating player's wagers after each set of common cards is dealt and revealed.

8. The method of claim 7 further comprising allowing players an option to surrender wagers and cards after each set of common cards is dealt and revealed.

9. The method of claim 1 further comprising requiring each player to place three wagers, said wagers placed initially, after a first set of common cards is dealt and after a second set of common cards is dealt.

10. The method of claim 9 further comprising requiring the three wagers to be of equal amounts.

11. The method of claim 9 further comprising requiring each player to place a fourth wager after a third set of common cards is dealt.

12. The method of claim 11 further comprising requiring the fourth wager to be of an equal amount to the first three wagers.

13. The method of claim 1 further comprising facilitating the method with a gaming table, electronic gaming device or global computer network.

* * * * *

UNITED STATES PATENT AND TRADEMARK OFFICE

CERTIFICATE OF CORRECTION

PATENT NO. : 7,438,295 B2
APPLICATION NO. : 11/296161
DATED : October 21, 2008
INVENTOR(S) : Masao Aida It is certified that error appears in the above-identified patent and that said Letters Patent is hereby corrected as shown below:

Title page item [75] Inventor's address is shown as: 8238 Park Place. Correct address is: 823 B Park Place.

Signed and Sealed this

Twenty-fourth Day of February, 2009

JOHN DOLL
*Acting Director of the United States Patent and Trademark Office*